US010092115B2

(12) United States Patent
González Morlans

(10) Patent No.: US 10,092,115 B2
(45) Date of Patent: Oct. 9, 2018

(54) CLOSING MECHANISM FOR REFRIGERATED DISPLAY CABINETS

(71) Applicant: Sergio González Morlans, Barcelona (ES)

(72) Inventor: Sergio González Morlans, Barcelona (ES)

(73) Assignee: SERGIO GONZALEZ MORLANS, Barcelona (ES)

( * ) Notice: Subject to any disclaimer, the term of this patent is extended or adjusted under 35 U.S.C. 154(b) by 0 days.

(21) Appl. No.: 14/849,692

(22) Filed: Sep. 10, 2015

(65) Prior Publication Data

US 2016/0174736 A1 Jun. 23, 2016

(30) Foreign Application Priority Data

Dec. 23, 2014 (ES) ..... 201431923

(51) Int. Cl.
*A47F 3/04* (2006.01)
*A47F 3/00* (2006.01)
*A47F 3/06* (2006.01)

(52) U.S. Cl.
CPC ..... *A47F 3/0434* (2013.01); *A47F 3/007* (2013.01); *A47F 3/043* (2013.01); *A47F 3/0413* (2013.01); *A47F 3/0469* (2013.01); *A47F 3/0486* (2013.01); *A47F 3/06* (2013.01)

(58) Field of Classification Search
CPC ..... A47F 3/434; A47F 3/06; A47F 3/0434; A47F 3/007; A47F 3/0413; A47F 3/0486; A47F 3/005
USPC ..... 312/116, 138.1, 139.1, 139.2
See application file for complete search history.

(56) References Cited

U.S. PATENT DOCUMENTS 2,621,097 A * 12/1952 Steinberg ..... A47F 3/005 312/109
4,836,622 A * 6/1989 Ferguson ..... A47F 3/007 108/92
5,069,512 A * 12/1991 Sykes ..... A47F 3/005 248/205.3
6,758,539 B2 * 7/2004 Cianetti ..... A47F 3/007 312/137
7,780,249 B2 * 8/2010 Cianetti ..... A47F 3/007 312/137
7,857,402 B2 * 12/2010 Anikhindi ..... E05D 15/20 312/319.4
2008/0169735 A1 * 7/2008 Yamazaki ..... A47F 3/06 312/114
2012/0279130 A1 * 11/2012 Appeldoorn ..... E06B 3/4645 49/252
2013/0285518 A1 * 10/2013 Stelmasik ..... A47F 3/005 312/139.2

(Continued)

*Primary Examiner* — Daniel J Troy
*Assistant Examiner* — Timothy Michael Ayres
(74) *Attorney, Agent, or Firm* — Klauber & Jackson LLC

(57) ABSTRACT

Closing mechanism (1) for refrigerated display cabinets (2), of the type display cabinets (2) that implement a movable closing section (3), said mechanism (1) being disposed relating said movable section (3) with the body (4) of the display cabinet (2) to open and close it, and said movable section (3) having a part projected (8) over the product arrangement area (9), normally fully or partially materialized in transparent material, wherein the mechanism (1) comprises independent frontal displacement means and independent lateral displacement means on either side indifferently.

5 Claims, 4 Drawing Sheets

(56) References Cited

U.S. PATENT DOCUMENTS

2014/0026488 A1* 1/2014 Andersson ..... E05D 15/1065
49/210

* cited by examiner

CLOSING MECHANISM FOR REFRIGERATED DISPLAY CABINETS

This application claims the benefit of, and priority to Spanish Patent Application Number 201431923 filed on Dec. 23, 2014 entitled, "CLOSING MECHANISM FOR REFRIGERATED DISPLAY CABINETS", the content of which is relied upon and incorporated herein by reference in its entirety.

DESCRIPTION

Object of the Invention

The invention relates to a closing mechanism for refrigerated display cabinets that enables greater ease of aperture and versatility of arrangement thereof.

Background of the Invention

Refrigerated display cabinets having, at least, one movable section, normally the front section, as the rear of the display cabinet is occupied by display counters and work elements.

This movable section usually has a pay t having straight, inclined or curved configuration that projects over the product arrangement area to protect it, prevent the loss of BTUs, facilitate the delivery of the products to customers and improve the observation of the products, said section normally being fully or partially made of transparent material, such as laminated or tempered glass. The aperture of the movable section makes it possible to perform various tasks, such as cleaning, replacement of products or maintenance and is divided into three systems: aperture towards the operator rotating from the base, upward aperture with different types of grips and the more modern fixed lateral sweep aperture.

In this last system, said movable section comprises a closing mechanism having fixation elements fixed movably to the body of the display cabinet. This mechanism comprises parallel supporting connecting rods articulated by one end to the body of the display cabinet and by the other to a lower upright belonging to the movable section. Said connecting rods have rotary motion in a substantially horizontal plane that instills a curved sweeping movement on the movable section in the horizontal plane with simultaneous frontal and lateral displacement, and the consequent aperture of the display cabinet, in the closed position of the movable section, the connecting rods are aligned and disposed between the upright and the body of the display cabinet and, in the open position, the connecting rods adopt a substantially parallel position during rotation thereof.

This configuration of the mechanism has various drawbacks, namely:

In display cabinets perpendicularly adjacent to a wall, the mechanism must be configured so that the movable section opens in a position opposite the wall, leaving a very small space between the open section and the wall that impedes the performance of tasks in the interior of the display cabinet.

The movable section is right/left-handed, i.e. it always opens in the same lateral direction, which limits versatility of aperture combined with other movable sections located on either side, belonging to the same display cabinet or to others.

Horizontal parts cannot be disposed on the closing section, as the curved lateral sweep from the start of the aperture of the movable section would interfere with the horizontal parts of the adjacent fixed sections, impeding aperture. This represents a major drawback consisting of the absence of horizontal parts or surfaces on which to rest the sold product while delivering it, obliging the seller and customer to adopt forced postures and strain themselves, or to install false horizontal surfaces.

Neither do configurations involving aperture towards the operator, rotation from the base and upward aperture, allow convenient access to the display cabinet to perform any of the aforementioned tasks.

DESCRIPTION OF THE INVENTION

The closing mechanism for refrigerated display cabinets has a simple configuration that remediates the aforementioned drawbacks.

The mechanism is therefore implemented in a display cabinet of the type comprising a movable closing section, said mechanism being disposed relating said movable section with the body of the display cabinet to open and close it, understanding 'body of the display cabinet' to be the rest thereof and/or its fixed accessories. Also, said movable section has a part that projects over the product display area, normally fully or partially materialised in transparent material.

In accordance with the invention, the mechanism comprises means with independent frontal displacement means and independent lateral displacement means indifferently on either side, understanding independent displacement means to mean that the lateral movement, of the lateral displacement means does not imply the longitudinal movement of the frontal displacement means and vice versa, firstly allowing the frontal extraction of the movable section followed by the lateral displacement thereof, without interfering with other adjacent display cabinets. With this configuration, the projected part of the movable section may incorporate horizontal sections that serve as a support on which to deliver the sold product or collect payment thereof.

DESCRIPTION OF A PRACTICAL EMBODIMENT OF THE INVENTION

Figure 1:
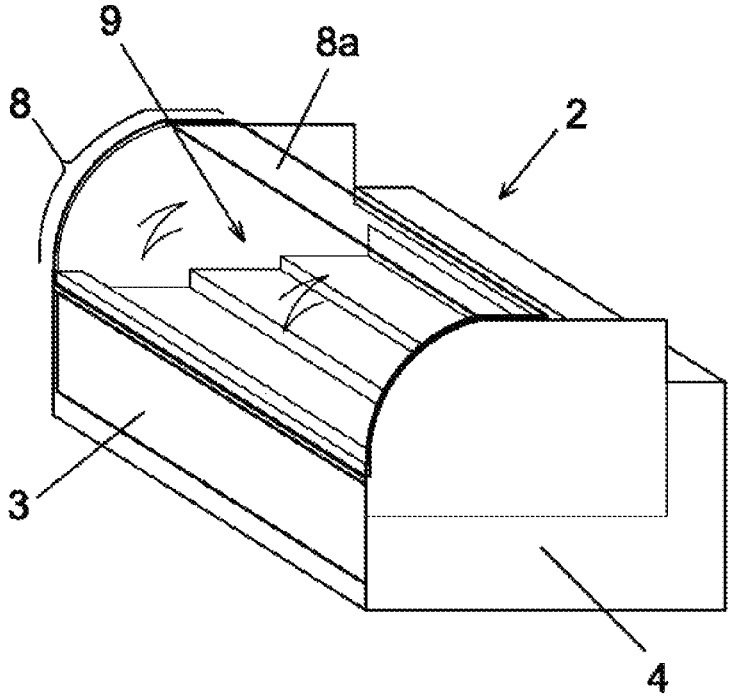
FIG. 1 shows a general view of a refrigerated display cabinet incorporating the mechanism of the invention, in a position wherein the movable section is closed.
Figure 2:
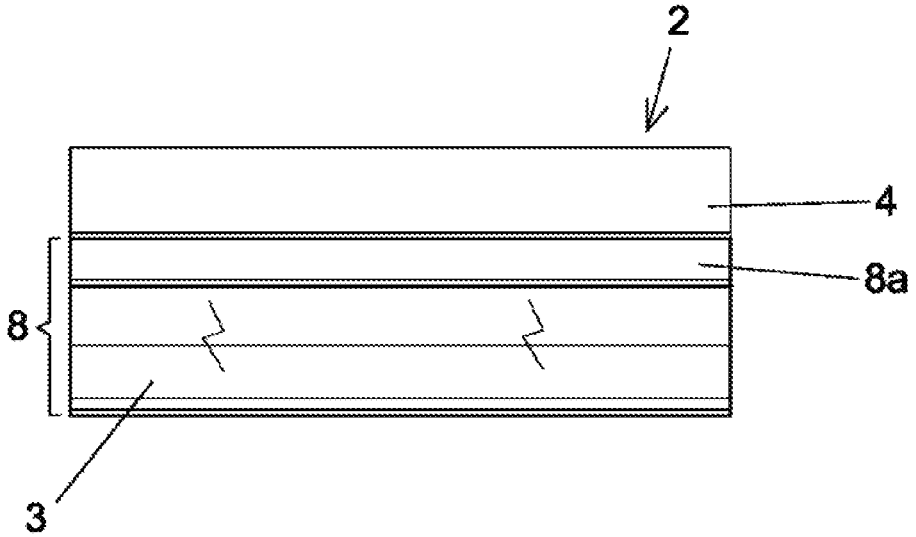
FIG. 2 shows a plan view of the display cabinet in the position shown in FIG. 1.
Figure 3:
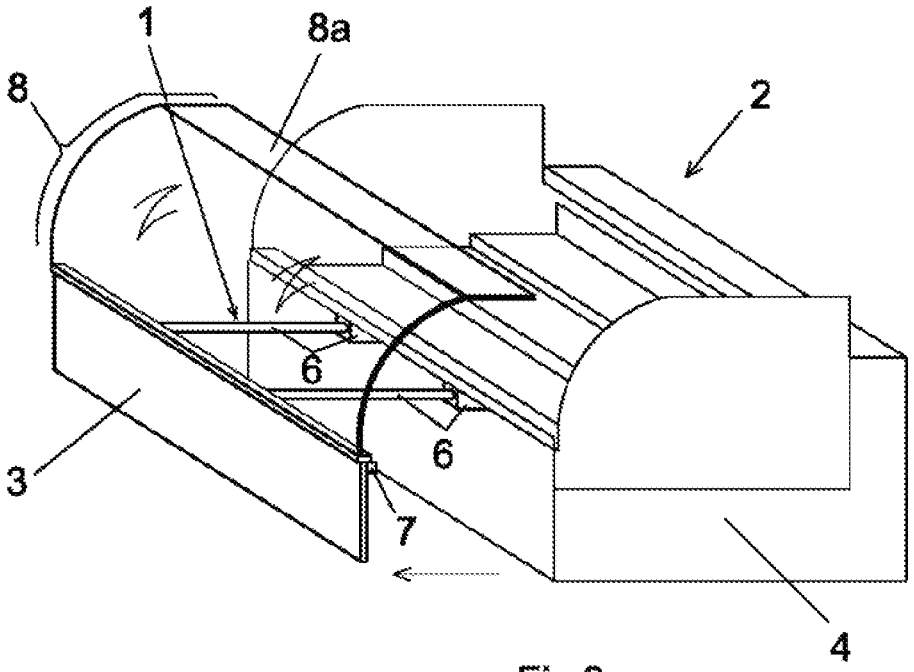
FIG. 3 shows a general view of the display cabinet of FIG. 1 in a position with the movable section frontally extracted by means of the mechanism of the invention.
Figure 4:
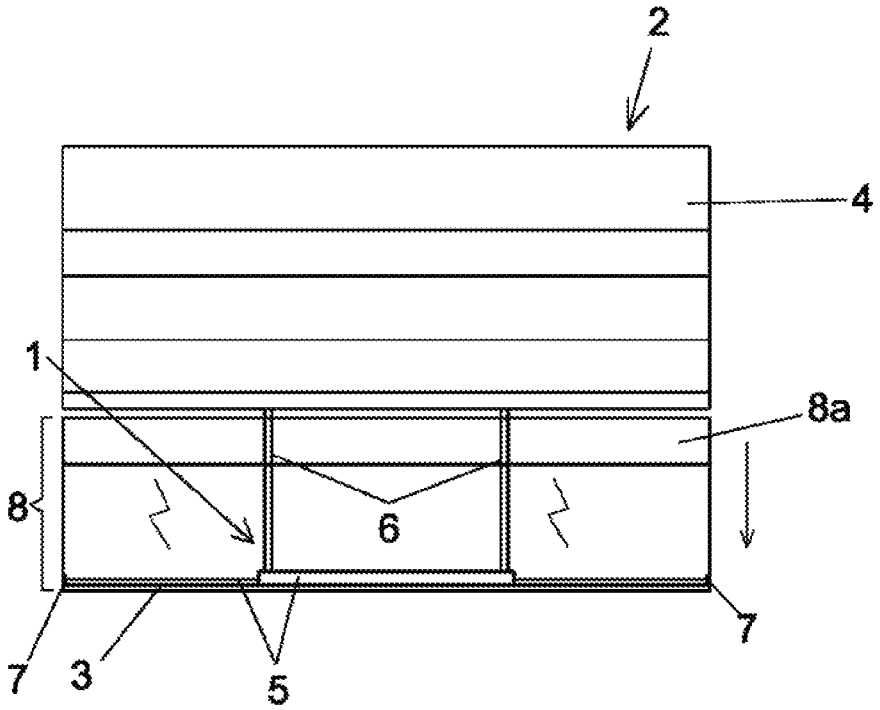
FIG. 4 shows a plan view of the display cabinet in the position shown in FIG. 3.
Figure 5:
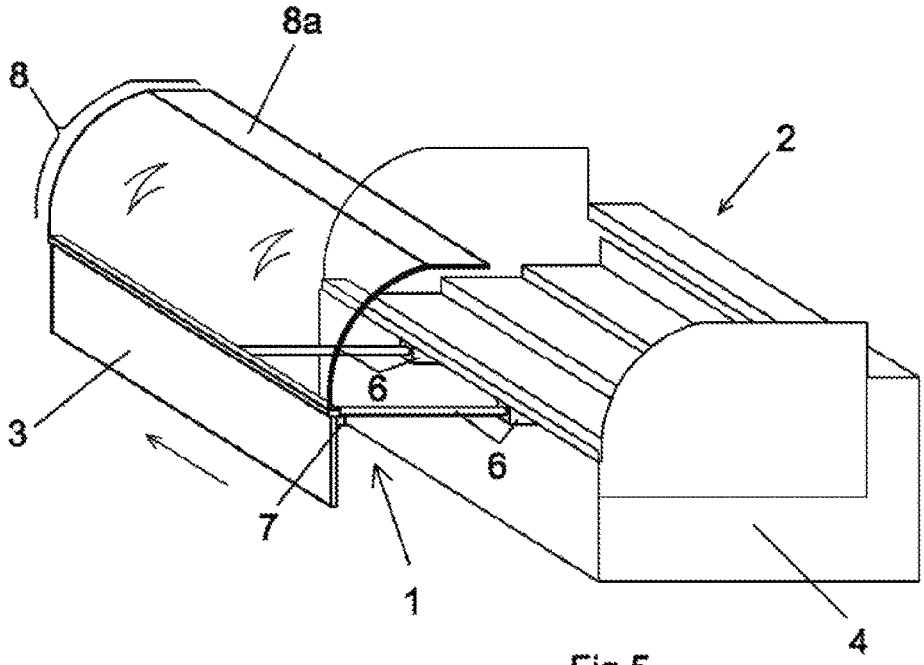
FIG. 5 shows a general view of the display cabinet of FIG. 1 in a position with the movable section frontally extracted and displaced laterally towards the left by means of the mechanism of the invention.
Figure 6:
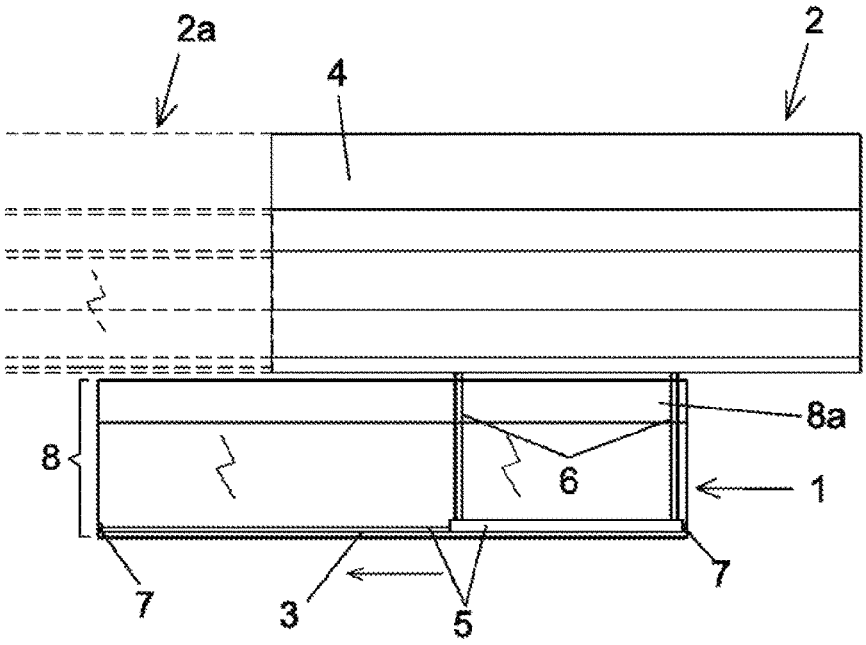
FIG. 6 shows a plan view of the display cabinet in the position shown in FIG. 5.
Figure 7:
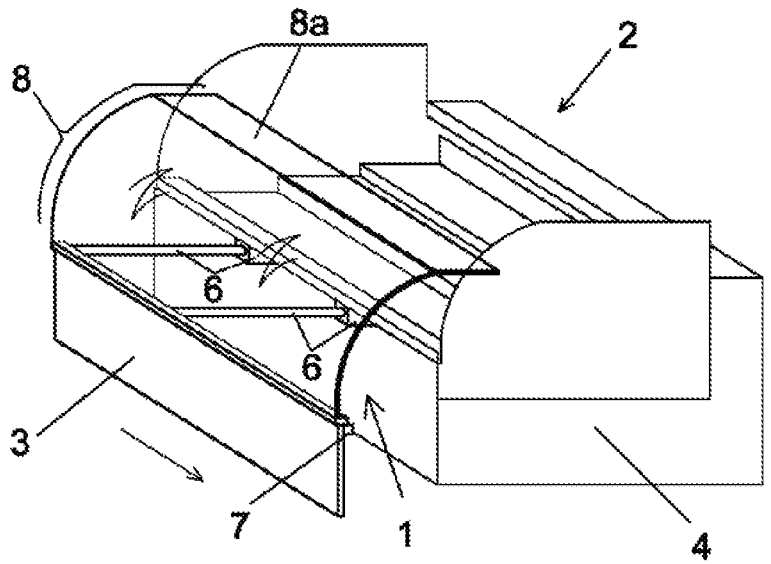
FIG. 7 shows a general view of the display cabinet of FIG. 1 in a position with the movable section frontally extracted and displaced laterally towards the right by means of the mechanism of the invention.
Figure 8:
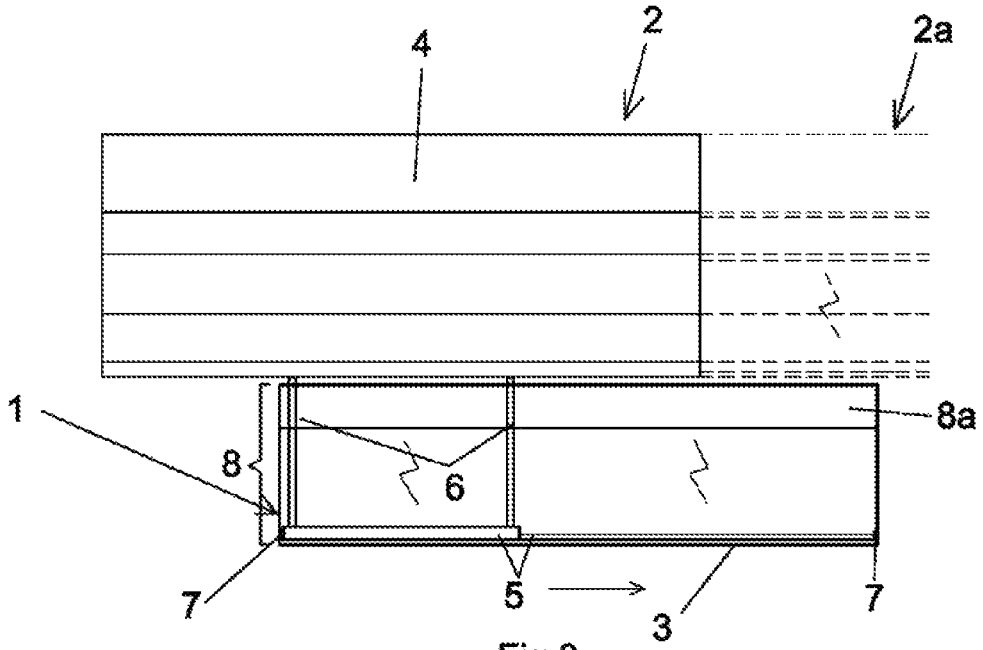
FIG. 8 shows a plan view of the display cabinet in the position shown in FIG. 7.

The closing mechanism (1) for refrigerated display cabinets (2) of the invention is configured in a display cabinet (2)

of the type implementing a movable closing section (3), said mechanism (1) being: disposed relating said movable section (3) with the body (4) of the display cabinet (2) to open and close it, as shown in FIGS. 3 to 8, said movable section (3) having a part projected (8) over the product display area (9) fully or partially made of transparent material. The figures show how this projected part (8) has horizontal sections (8*a*) that configure a kind of shelf on which to place the product or make payments in the commercial transaction.

In accordance with the invention, the mechanism (1) comprises independent frontal displacement means and independent lateral displacement means on either side indifferently for the movable section (3). This makes it possible to open said movable section (3) as shown in the sequences configured by FIGS. 1, 3 and 5 and/or 1, 3 and 7, without the upper horizontal section (8*a*) interfering laterally with similar sections of the other identical display cabinets (2*a*) located on one or both sides of the display cabinet (2) considered. It also allows aperture towards both sides, facilitating the tasks to be performed with the movable section (3) open.

In the non-limiting example shown in the figures, the frontal displacement means are supported by the body (4) of the display cabinet (2) (see FIG. 3, 5 or 7) and comprise linear bearings (6), although they could complementarily or alternatively comprise other equivalent elements belonging to the state of the art, such as frontally sliding elements, telescopic elements, etc., not shown. As regards the lateral displacement means, in this non-limiting example they comprise laterally sliding elements (5) (see FIG. 4, 6 or 8), Also, in general, the lateral displacement means may be disposed coupled to the frontal displacement means, maintaining the independence of their movements. For example, in the figures it can be observed how the laterally sliding elements (5) are coupled to the end of the linear bearings (6).

If the movable section (3) is very heavy, the installation of rolling supports, not shown, has additionally been envisaged, such as directionally rotating wheels that can be implemented directly on the movable section (3) and/or on the lateral displacement means and/or on the frontal displacement means.

Lastly, the installation of travel stops (7) for limiting the travel of the independent lateral displacement means and/or the independent frontal displacement means has been envisaged. The figures show the travel stops (7) for limiting the travel of the independent lateral displacement means.

Having sufficiently described the nature of the invention and the manner in which to put it into practice, it is hereby stated that the indications mentioned above and represented in the attached drawings are susceptible to changes in detail, provided that they do not alter the basic principle.

The invention claimed is:

1. Refrigerated display cabinet comprising a body, a movable section, and a closing mechanism, said closing mechanism connecting the movable section of the display cabinet with the body of the display cabinet for opening and closing said display cabinet, wherein said movable section has the same angular orientation through all positions of movement, wherein said movable section has a part projected over a product arrangement area having a horizontal section forming a shelf for supporting a product or collecting a payment thereof, wherein the part projected over the product arrangement area and the horizontal section are fully made of a transparent material, wherein said closing mechanism comprises independent frontal displacement means and independent horizontally lateral displacement means, and said independent frontal displacement means and said independent lateral displacement means are coupled to each other, said independent lateral displacement means includes a movement rail mounted to said movable section and a stationary rail on which the movement rail travels linearly on, wherein said independent frontal displacement means includes a pair of outer telescopic elements that are each mounted to a shelf in the body of the display cabinet and a pair of inner telescopic elements that each travel linearly in a respective outer telescopic element, an outer end of each of the inner telescopic elements is mounted to a respective end of the stationary rail, wherein the frontal displacement means causes the movable section to move along a perpendicular axis that is in a perpendicular direction with respect to the front surface of the cabinet and the horizontally lateral displacement means causes the movable section to move along a lateral axis that is in a horizontal parallel direction with respect to the front surface of the cabinet, and wherein the independent horizontally lateral displacement means can be opened and can move towards either side.

2. Refrigerated display cabinet according to claim 1, wherein the independent frontal displacement means comprise linear bearings.

3. Refrigerated display cabinet according to claim 1, wherein the inner and outer telescopic elements slide relative to each other.

4. Refrigerated display cabinet according to claim 1, wherein the movement rail and stationary slide relative to each other.

5. Refrigerated display cabinet according to claim 1, comprising travel stops for limiting the travel of the independent lateral displacement means and independent frontal displacement means.

* * * * *